US006609820B2

(12) United States Patent
Litwiller

(10) Patent No.: US 6,609,820 B2
(45) Date of Patent: Aug. 26, 2003

(54) INTERNAL SPRING MEMBER AGITATING MECHANISM FOR AGITATING MATERIALS WITHIN SEALED CONTAINERS

(75) Inventor: Debora M. Litwiller, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 105 days.

(21) Appl. No.: 10/022,227

(22) Filed: Dec. 20, 2001

(65) Prior Publication Data

US 2003/0117892 A1 Jun. 26, 2003

(51) Int. Cl.[7] ..... B01F 11/00

(52) U.S. Cl. ..... 366/118; 366/332; 399/254; 222/DIG. 1

(58) Field of Search ..... 366/117, 118, 366/241, 242, 255, 256, 275, 332, 333, 342, 343, 349; 399/254, 255, 257; 222/409, DIG. 1

(56) References Cited

U.S. PATENT DOCUMENTS 3,724,725 A * 4/1973 Stauffer
4,732,487 A * 3/1988 Pollard
4,739,907 A 4/1988 Gallant
4,811,867 A * 3/1989 Deyle, Jr. et al.
4,943,830 A * 7/1990 Sulenski
5,139,176 A * 8/1992 Reindl et al.
5,289,955 A * 3/1994 Sulenski
5,495,323 A 2/1996 Meetze, Jr.
5,500,719 A 3/1996 Ichikawa et al.
5,575,408 A * 11/1996 Marqueling et al.
5,576,816 A 11/1996 Staudt et al.
5,678,121 A 10/1997 Meetze, Jr. et al.
5,903,806 A 5/1999 Matsuoka et al.
5,978,632 A * 11/1999 Kimura et al.
6,169,864 B1 1/2001 Baxendell et al.
6,266,511 B1 * 7/2001 Murakami et al.

* cited by examiner

*Primary Examiner*—Charles E. Cooley
(74) *Attorney, Agent, or Firm*—Richard F. Spooner

(57) ABSTRACT

This invention relates to the packaging and subsequent removal of material that tends to clump or congeal when shipped or stored in containers. A mechanism and process for agitating material held in a container is disclosed. The agitating mechanism includes a device such as a spring for storing potential energy in a locked down position. When desired, the potential energy is released, and an agitating member moves through the materials to break apart clumps or congealed materials in order to aid flow rates and uniformity. One embodiment of the present invention relates to cartridges for storing marking materials for reprographic systems.

31 Claims, 6 Drawing Sheets

INTERNAL SPRING MEMBER AGITATING MECHANISM FOR AGITATING MATERIALS WITHIN SEALED CONTAINERS

CROSS REFERENCE TO RELATED APPLICATIONS

Reference is made to commonly-assigned copending U.S. patent application Ser. No. 10/022,230, filed Dec. 20, 2001, entitled: DRY INK REPLENISHMENT BOTTLE WITH INTERNAL PLUG AGITATION DEVICE, by Meetze, et al and U.S. patent application Ser. No. 10/022,229, filed Dec. 20, 2001, entitled: SELF-CLEANING MECHANISM ENABLING VISIBILITY INTO CONTAINERS OF PARTICLES, by Litwiller.

BACKGROUND OF THE INVENTION

This invention relates to the packaging and subsequent removal of material that tends to clump or congeal when shipped or stored in containers. Many materials are packaged and shipped in particulate, pelletized, or granulated form, and some liquid/solid mixtures such as suspensions tend to form gels or to congeal into gelatinous clumps when shipped or stored. Unless special packaging arrangements are made, such liquid/solid mixtures and particulate or granulated matter typically settle and become more densely packed over time. A frequent consequence of such dense packing is often the formation of clumps when particles or liquid/solid mixtures are removed from their containers. For many products, such settling and clumping does not matter for the intended use. For other products, the particles, granules, and congealed material can be restored by agitating and/or aerating the particles or mixtures before the intended use. A common household example pertaining to particulate matter is the process of sifting flour before measuring and adding the flour to a batch for bread, cake, and similar baked items. Certain candies are also known to stick together in their containers during storage. Similarly, shaking of liquid/solid suspensions such as salad dressings restores the desired mixture composition. For some products, however, it is not practical or possible to perform such agitation and aerating from outside of the packaging in which the material has been stored or shipped. The present invention deals with a novel apparatus and method for providing in situ agitation and aeration within a container that is sealed before use. This apparatus and method obviates the need for human intervention such as shaking or tapping a container, thereby making the degree and type of agitation more reliable.

Although the handling and use of any number of particulate, granulated or pelletized products and liquid/solid mixtures may benefit from the present invention, the invention is described in relation to sealed containers that transport and load dry marking inks such as toner or a combination of toner and developer particles into printing machines such as electrophotographic copiers, printers, etc.

Generally, in the process of electrostatographic printing, a photoconductive insulating member is charged to a substantially uniform potential to sensitize the surface thereof. The charged portion of the photoconductive insulating layer is thereafter exposed to a light image of an original document to reproduced. This records an electrostatic latent image on the photoconductive member corresponding to the information areas contained within the original document. Alternatively, in a printing application, the electrostatic latent image may be created electronically by exposure of the charged photoconductive layer by an electronically controlled laser beam or light emitting diodes. After recording the electrostatic latent image on the photoconductive member, the latent image is developed by bringing a developer material charged of opposite polarity into contact therewith. In such processes the developer material may comprise a mixture of carrier particles and toner particles or toner particles alone (both these single component and dual component development systems shall hereinafter be called "toner"). Toner particles are attracted to the electrostatic latent image to form a toner powder image that is subsequently transferred to copy sheet and thereafter permanently affixed to copy sheet by fusing.

In such a printing machines, the toner material is consumed in a development process and must be periodically replaced within the development system in order to sustain continuous operation of the machine. Various techniques have been used in the past to replenish the toner supply. Initially, new toner material was added directly from supply bottles or containers by pouring to the developer station located within the body of the automatic reproducing machine. The addition of such gross amounts of toner material altered the triboelectric relationship between the toner and the carrier in the developer station, thereby resulting in reduced charging efficiency of the individual toner particles and accordingly a reduction of the development efficiency when developing the electrostatographic latent image on the image bearing surface. In addition, the pouring process was both wasteful and dirty in that some of the toner particles became airborne and would tend to migrate into the surrounding area and other parts of the machine. Accordingly, separate toner hoppers with a dispensing mechanism for adding the toner from the hopper to the developer station in the printing machines on a regular or as needed basis have been provided. In addition, it has become common practice to provide replenishment toner supplies in a sealed container that, when placed in the printing machine, can be automatically opened to dispense toner into the toner hopper. In some of these designs, the toner cartridge may itself serve as the toner hopper. After this type of toner cartridge is mated to the printing machine at an appropriate receptacle, mechanisms are inserted into the toner cartridge that serve to transport the toner from the toner cartridge into the developer station or an intermediate toner hopper on a regulated basis. See, U.S. Pat. No. 5,903,806 issued to Matsunka et al.; U.S. Pat. No. 5,678,121 issued to Meetze et al.; and U.S. Pat. No. 5,495,323 issued to Meetze. In other designs, the toner cartridge is mated to the appropriate receptacle of the printing machine and then toner is dumped all at once from the toner cartridge into a toner hopper within the printing machine. Such toner in the hopper is then drawn into the developer station on a regulated basis. The toner cartridge, once its contents are dumped, is removed from the receiving receptacle and is either discarded or recycled.

In any design utilizing a customer replaceable toner cartridge for replenishment, one difficulty that arises is the uniform dispensing of the toner. In particular, toner particles are known to settle and clump during shipment and storage. This clumping phenomenon is caused for a variety of reasons: 1) particles of smaller size can fill and pack spaces between larger articles; 2) toner particles are often tacky; and 3) the electrostatic properties of toner particles enable charge attractions between particles. The result is often agglomerations, or clumps, of particles within the toner cartridge. These agglomerations often compact and form bridging structures within the toner cartridge, and such bridging structures adhere to the sides of the toner cartridges. Simple probes and augers as disclosed in patents such as U.S. Pat. No. 5,903,806 issued to Matsunka et al., U.S. Pat. No. 5,678,121 issued to Meetze et al., and U.S. Pat. No. 5,495,323 issued to Meetze may penetrate such agglomerations and bridging structures but do not break them up. Even rotation of the cartridges after mating onto a printing machine toner receptacle does not impart enough energy to shake the clumped toner particles apart from its various clumps and bridging structures. Since toner cost is a major component of the total cost of printing, any significant amount of toner left in a toner cartridge significantly increases the effective cost of using the printer. Worse, customers that do not receive the expected print volume from a cartridge may assume that the cartridge is faulty and make a warranty claim. In other cases, such customers have been known to make a service call that consumes valuable service and technician time.

In response to the above problems related to removal of substantially all toner from toner cartridges, various devices and procedures have been developed. One effective procedure when performed correctly is simply the shaking of a toner cartridge by human operators prior to mating the cartridge with the printing machine receptacle. However, many operators do not read the instructions and do not know or remember that toner cartridges need to be shaken. In addition, even when operators read instructions, humans inevitably interpret product instructions subjectively such that an instruction to "vigorously agitate" a cartridge may lead to too much force by a few operators and too little by others. The result is that some cartridges are shaken or pounded hard enough to be damaged while others are not shaken enough to break up clumps and bridges that may have formed. Once the cartridge is mated to the receiving receptacle while the toner particles remain clumped and bridged, the operator is left with several choices: One is to leave the cartridge as is and to risk wasting toner and/or believing that the printing system is consuming too much toner. A second choice is removal of the cartridge with its seals open, thereby risking contaminating the toner itself plus spilling the difficult-to-clean particles. A third choice is to try to strike, squeeze, or otherwise agitate the toner cartridge in situ. In addition to the probability that some toner nevertheless remains within the cartridge, such agitation in situ risks damage to the mating receptacle and associated parts of the printing machine. The end result is a frequent waste of valuable toner and a resulting increase in the costs of operating the printing machines plus the risk of warranty and service events.

Manufacturers of printing and other systems understand that human operators do not always follow instructions or perform the instructed activities correctly. In effect humans are inherently uncontrollable elements when asked to perform control processes. Accordingly, a number of automated solutions have been attempted. For toner cartridges that are mounted onto printing machines in order that toner be extracted in a regulated fashion, such cartridges are now often cylindrical in shape with spiral ribs located on the inside peripheral walls of the cartridges. An example of such prior art cartridges is shown in U.S. Pat. No. 5,495,323 issued to Meetze incorporated and is hereby incorporated by reference. See also, U.S. Pat. No. 5,903,806 issued to Matsuoka et al. and U.S. Pat. No. 5,576,816 issued to Staudt et al. that both disclose substantially cylindrical toner cartridges having on their peripheral surface a spiral groove. The toner cartridge and the receiving apparatus operate to rotate the cartridge and to thereby transport the toner within the spiral groove. The apparatus includes a supplying element in the form of an opening and a regulating device. Although toner cartridges with such spiral grooves are effective in urging toward the mouth of the cartridge, such grooves by themselves do little to break up the clumps or bridging described above. Even when the apparatus includes a probe, auger, or similar device that penetrates the stored toner in a cartridge, current designs place such probes only along the central axis of the cartridge. Toner clumped or agglomerated along the periphery of the toner cartridge may not be jostled or mixed by either the rotation of the cartridge or by the probe itself.

At least one prior art device employed a helical member such as a spring inside the toner cartridge for the express purpose of breaking up clumps, bridges, and other agglomerations. In U.S. Pat. No. 4,739,907, issued to Gallant, a cylindrical toner cartridge includes a dispensing opening at one end and an integral toner transport, mixing, and anti-bridging member rotatably supported within the container. The transport, mixing, and anti-bridging member comprises a first coiled spring element having a cross section substantially the same as the cross section of the cartridge and freely rotatable therein, which spring is wound in the direction to transport toner along its length toward the dispensing opening. The member also comprises a second coiled spring element having a cross section substantially smaller than the first spring element but being substantially concentrically positioned and being attached to the first spring element but wound in a direction opposite to the first spring element. In this manner, rotation of the cartridge while the spring members remain substantially fixed results in the scraping of clumped toner from the sides of the cartridge and mixing and penetration of any agglomerations and bridges within the interior of the cartridge by the inner spring.

One limitation to the above prior art cartridges and devices is that each is designed to work in or in conjunction with toner cartridges that rotate once mated to a toner receptacle on the printing machine. Without rotation of the cartridge, neither spiral grooves nor fixedly located springs actively engage toner particles within the cartridge. Additionally, recent advances in imaging and toner production has led to smaller toner particles that now may average less than 10 microns. In order to overcome electrostatic forces that tend to attract particles together, a substantial amount of aeration of the toner particles is preferred. It would be advantageous, therefore, to devise a toner cartridge assembly that both aerates toner and that automatically breaks up clumps and bridges within the toner even without rotating motion of the cartridge.

Although the above background for the present invention and several of its embodiments are explained in relation to toner cartridges, the present invention is believed to have wide applicability to any container of material, especially particulate matter prone to settle and clump and material prone to form gels or to congeal that nevertheless are easily removed once agitated.

SUMMARY OF THE INVENTION

Accordingly, one embodiment of the present invention is a mechanism for agitating material held in a container, comprising: (a) device that stores potential energy; (b) a lock-down mechanism that prevents release of energy from the spring member; (c) a releasing mechanism that, when engaged with the lock-down mechanism, prevents release of the potential energy from the spring member and, when disengaged from the lock-down mechanism, allows release of such potential energy from such spring member; and (d)

an agitating member powered upon release of potential energy from the spring member, at least a portion of such agitating member being powered to move through the material held in the container.

A further embodiment of the present invention is a process for agitating material held in a container, comprising: (a) storing potential energy in a spring member; (b) engaging a releasing mechanism with a lock-down mechanism to prevent release of the potential energy stored in the spring member; (c) releasing the potential energy from the spring member upon disengagement of the releasing mechanism from the lock-down mechanism; and (d) agitating the material held in the container by an agitating member powered by the released potential energy.

A further embodiment of the present invention is a process for agitating marking materials materials in a cartridge, comprising: (a) storing potential energy in a spring member; (b) engaging a releasing mechanism with a lock-down mechanism to prevent release of the potential energy stored in the spring member (c) releasing the potential energy from the spring member upon disengagement of the releasing mechanism from the lock-down mechanism; and (d) agitating the toner materials held in the cartridge by an agitating member powered by the released potential energy.

Yet a further embodiment of the present invention is a cartridge for holding marking materials, comprising: (a) a device that stores potential energy; (b) a lock-down mechanism that prevents release of energy from the potential energy storage device; (c) a releasing mechanism that, when engaged with the lock-down mechanism, prevents release of the potential energy from the potential energy storage device and, when disengaged from the lock-down mechanism, allows release of such potential energy from such potential energy storage device; and (d) an agitating member powered upon release of potential energy from the potential energy storage device, at least a portion of such agitating member being powered to move through the toner material held in the cartridge.

DETAILED DESCRIPTION OF THE DRAWINGS

While the present invention will hereinafter be described in connection with several embodiments and methods of use, it will be understood that this is not intended to limit the invention to these embodiments and methods of use. On the contrary, the following description is intended to cover all alternatives, modifications and equivalents, as may be included within the spirit and scope of the invention as defined by the appended Claims.

Figure 1:
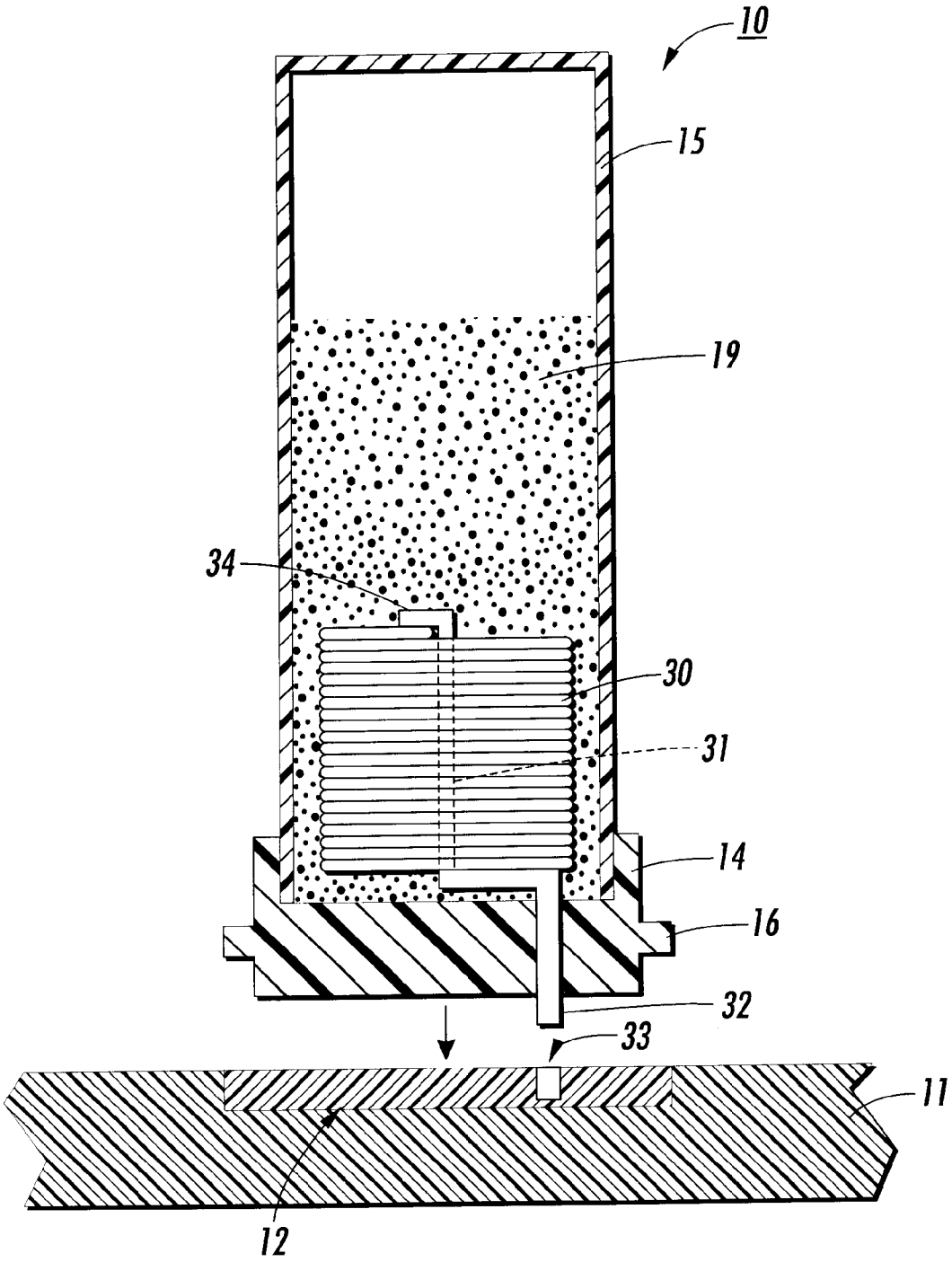
FIG. 1 is an elevated cross-sectional view of an exemplary toner cartridge embodiment of the present invention.
Figure 2:
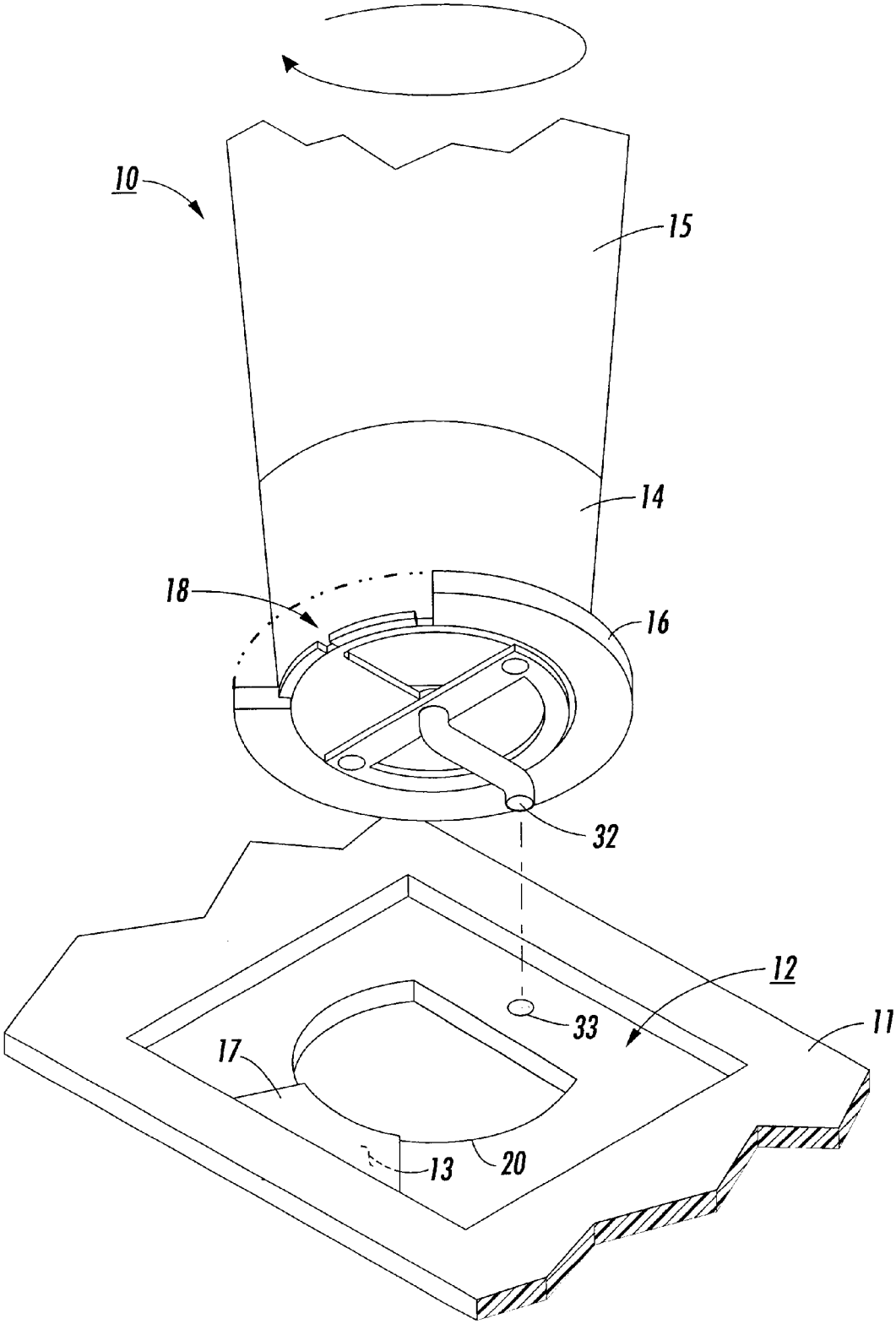
FIG. 2 is an elevated perspective close-up view of a container cap together with a printing system mating receptacle for such cap.

Turning now to FIG. 1, one embodiment of the present invention is shown. In this elevated cross-sectional view of an exemplary toner cartridge 10 of the present invention, the cartridge 10 is shown positioned above a mating receptacle apparatus 12 of a printing machine (not shown). In this embodiment, cartridge 10 comprises a clear or translucent cylindrical bottle 15 that is typically comprised of a thermoplastic material such as PVC. Cartridge 10 is sealed at its bottom end with a container cap 14 that is also typically made from thermoplastic resin. Turning to FIG. 2, an elevated close-up view of container cap 14 is shown. In this embodiment, a flange 16 is formed proximate to the base of container cap 14. Flange 16 encircles most but not all of the circumference of container cap 14. In this manner, at least one gap 18 is located on flange 16. The role of this flange 16 and its gaps will be discussed in conjunction with a description of mating apparatus 12 below.

Returning to FIG. 1, mating apparatus 12 is shown in a cross-sectional view. Mating apparatus 12 serves two functions: 1) it forms the receiving aperture 20 to toner receptacle 11 of the printing machine wherein toner is stored prior to delivery to the development station of the printing system, and 2) it mates tightly with toner cartridge 10 in order that toner can be transferred from cartridge 10 into receptacle 11 without spills or seepage of toner particles into the air or onto the neighboring surfaces of the printing system. Mating apparatus 12 may take a wide variety of forms. Returning to FIG. 2, one embodiment of a mating apparatus 12 is shown in an elevated perspective view. In this view, mating apparatus 12 comprises, in addition to its aperture 20 into the toner receptacle 11, at least one mating fixture 17 comprising a negatively sloped overhang surface 13. In order for toner cartridge 10 to be fully pressed into position on mating apparatus 12, flange 16 of toner cartridge 10 must be positioned such that gap 18 in flange 16 aligns with negatively sloped flanges 17. In this manner, toner cartridge 10 can slide past mating fixture 17 to rest firmly over the rim of aperture 20. Once toner cartridge 10 is so aligned and rested upon the rim of aperture 20, the operator can rotate the cartridge in place in a clockwise fashion (see arrow at top of FIG. 2). During such rotation, flange 16 of the container cap 14 engages the leading edge of negatively sloped mating fixture 17. As cartridge 10 is further rotated, the negative slope of mating fixture 17 presses flange 16 downward. Such downward pressure forces container cap 14 more firmly upon the rim of aperture 20, thereby ensuring a tight seal between cartridge 10 and toner receptacle 11. Also during such rotation closure mechanism 27 opens in order that material can flow out of container 10.

The apparatus within toner cartridge 10 and its container cap 14 will now be explained in relation to FIG. 1. As is conventional with toner cartridges, most of the volume of cartridge 10 is filled with particles of toner labeled in FIG. 1 as 19. As discussed above, material 18 can be any material for which the agitation provided by the present invention is advantageous. In addition to toner and other marking materials, material 19 may include, without limitation, pellets of candy or any tacky or waxy material, granules of sugar, salt, and any number of similar materials that tend to clump, settle, or stick together or to containers when stored or handled. A wide variety of liquid or liquid/solid materials that tend to gel or congeal can also comprise material 19.

Returning to the toner example of material 19 shown in FIG. 1, the toner particles have settled during shipment and storage such that a considerable volume of cartridge 10 is vacant of particulate matter. As described above, it is also common that particles such as toner will clump or form bridges within the toner cartridges and may therefore not settle in a uniform fashion or may clump with non uniform density.

Also shown in FIG. 1 is an agitating device 30. Such agitating device may take many forms. In the form shown in FIG. 1, a simple coiled compression spring is shown in its fully compressed position. Such a compression spring need not be coiled in a cylindrical shape and could be formed in a more rectangular shape for particulate containers with rectangular cross sections. Other possible embodiments of agitating device 30 may include, without limitation, negator springs, compressed foam, leaf springs, rubber bands, tension springs, or any other spring-like device that stores potential energy under compression and/or tension that can be released to cause rapid movement of an agitating device through a volume of particulate or congealed matter. For purposes of this invention, a "spring member" shall include all such spring-like devices. As will be explained, it is preferable although not necessary that the potential energy be released relatively rapidly in order to optimize the mixing and aeration of the particles in cartridge 10. Also, it should be noted that although FIG. 1 shows the agitating device in its pre-discharge position located proximate to container cap 14, agitating device 30 could also be located at the top of cartridge 10. Also, agitating device 30 could store its potential energy in a fully extended position. When released, such a device would contract, thereby imparting the desired agitating motion. This embodiment is shown more fully in FIG. 6, discussed below.

FIG. 1 also shows a switching or lock-down mechanism 31. In the embodiment shown, this lock-down mechanism comprises a simple metal bar extending over the top of coiled agitating device 30. At least a portion 34 of lock-down mechanism 31 is designed to engage a fixture 33 located on mating apparatus 12. In the embodiment shown, mechanism 31 is a bar that terminates in a locating and locking pin 32. This locating pin 32 extends below container cap 14. Fixture 33 is a relatively small receiving port with a shape conforming to locking pin 32. In this manner, pin 32 and fixture 33 supplement the gap 18 in flange 16 for positioning cartridge 10 precisely over the rim of receiving aperture 20. Moreover, once pin 32 is inserted into fixture 33, pin 32 is prevented from sliding during rotational movement of container 10 as discussed below.

Figure 3:
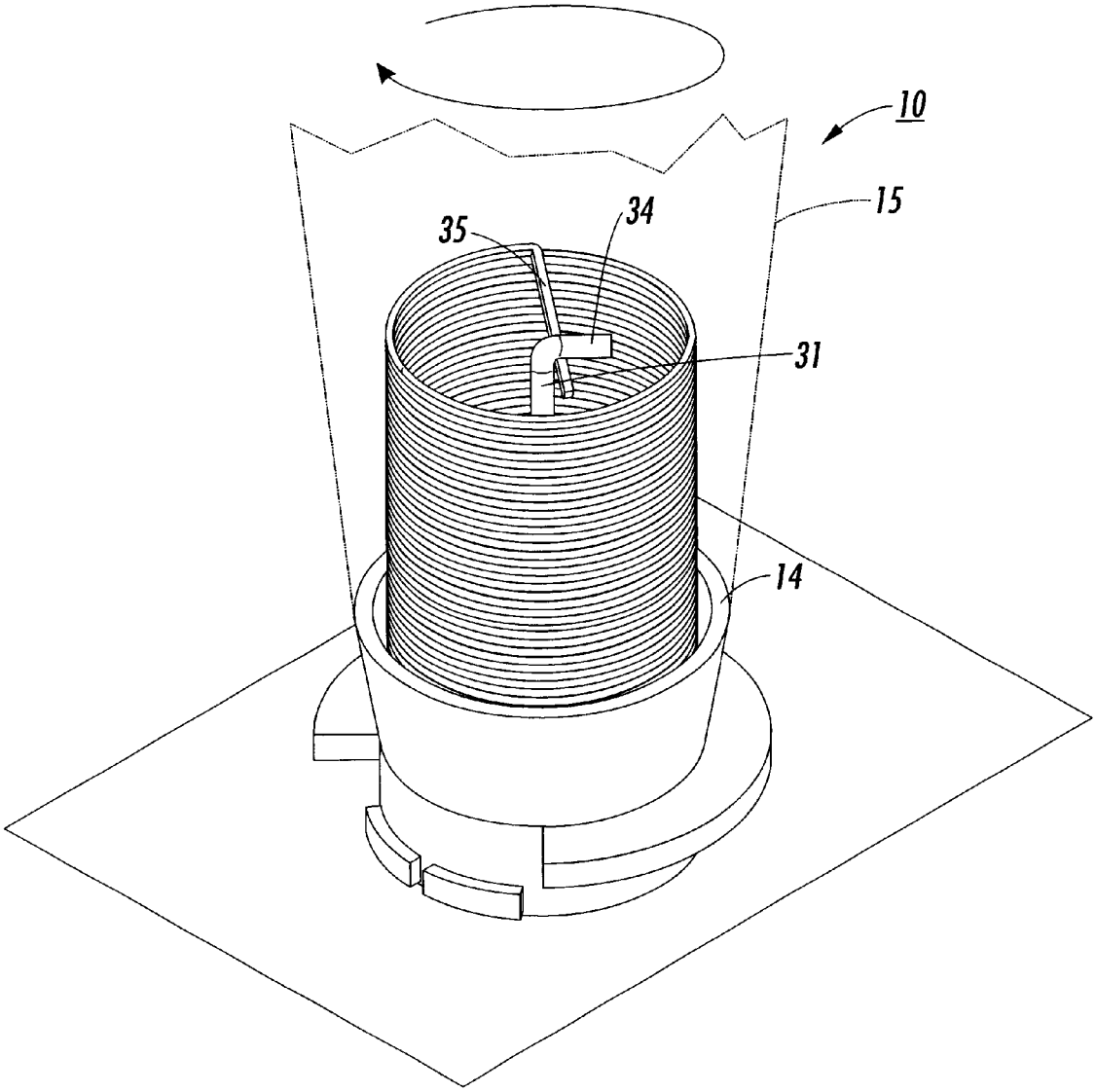
FIG. 3 is an elevated perspective view of the top of an agitating device embodiment of the present invention in its compressed position. The agitating device is attached to a container cap that is mated with a printing system.

Additional information regarding the lock-down function of mechanism 31 is shown in FIG. 3, which is an elevated perspective view of the top of agitating device 30 in its compressed position. For clarity, cartridge 10 has been cut away in FIG. 3 in order to better reveal the relationship between lock-down mechanism 31 and agitating device 30. As shown, the top portion of agitating device 30 terminates with an L-shape bend and an extension section 34 that extends essentially horizontally. Extension section 34, in turn, engages cross member wire 35. Cross member 35 comprises one embodiment of a releasing mechanism that, when combined with lock-down mechanism 31, forms a type of switch. In the embodiment shown, cross member 35 is simply the terminal segment of agitating device spring 30. Cross member 35 has been bent to essentially bisect the circumference of the spring of agitating device 30. Since, in this embodiment, lock-down mechanism 31 is vertically positioned at approximately the center of the spring diameter, extension section 34 engages cross member 35 approximately in the middle of agitating device spring 30.

As discussed above in relation to FIG. 2, the described embodiment of the present invention requires that the operator rotate container 10 in order to firmly press the container against aperture opening 20. During such rotation, as described above, locating pin 32 is mated with fixture 33 with the result that lock-down mechanism 31 cannot rotate. Since cross member 35 is attached to agitating device 30 and since agitating device 30 is fixedly attached to container cap 14, the orientation of cross member 35 in relation to extension section 34 of lock-down mechanism 31 changes during rotation of container 10.

Figure 4:
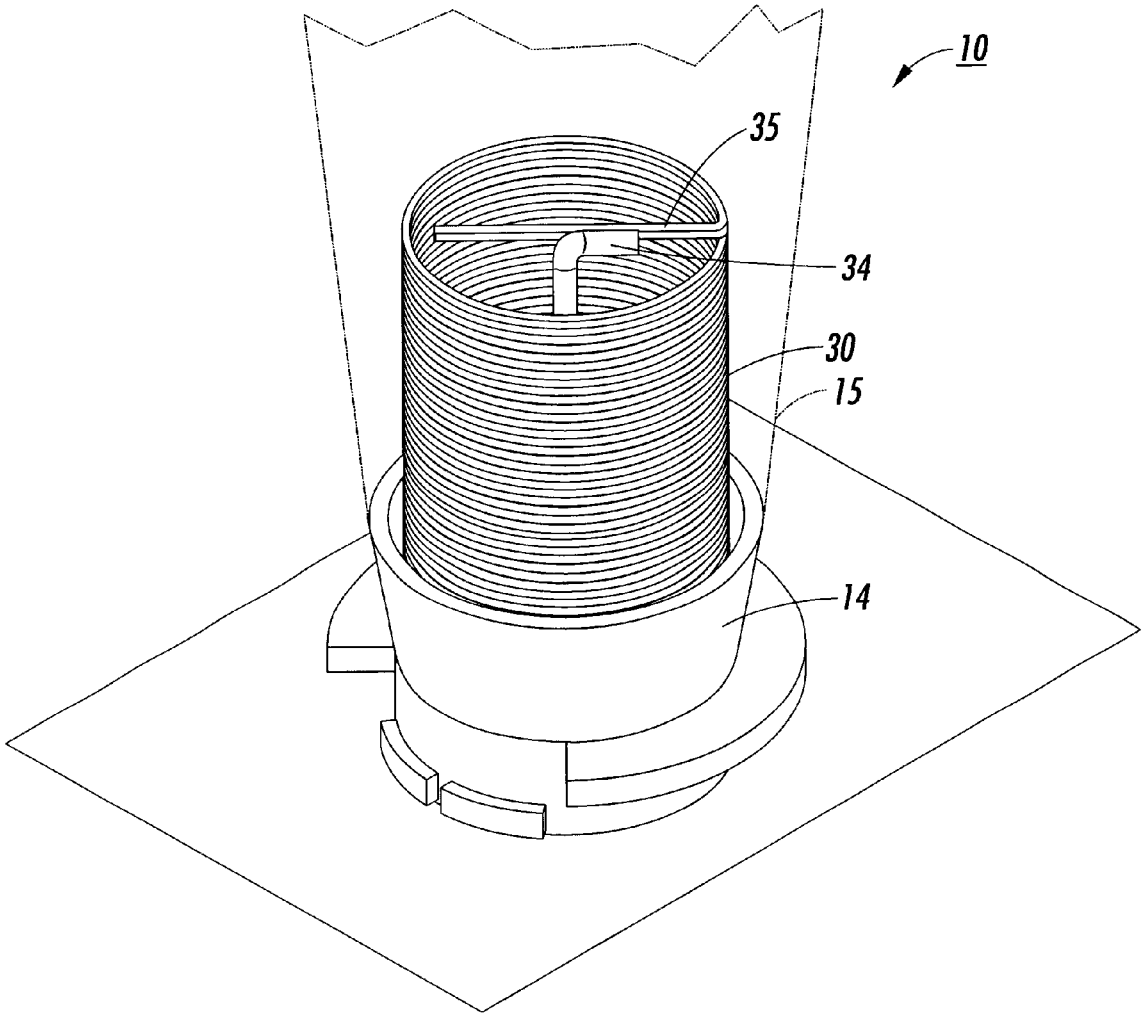
FIG. 4 is an elevated perspective view of a lock-down mechanism of the present invention after a change in its orientation in relation to a releasing mechanism.

FIG. 4 shows the change in orientation between cross member 35 and extension section 34 after container 10 is rotated approximately 90 degrees. As shown, extension section 34 no longer engages cross member 35. The result is that the potential energy stored in agitating device 30 is released. In the embodiment shown, it is free to spring freely into its extended position.

Figure 5:
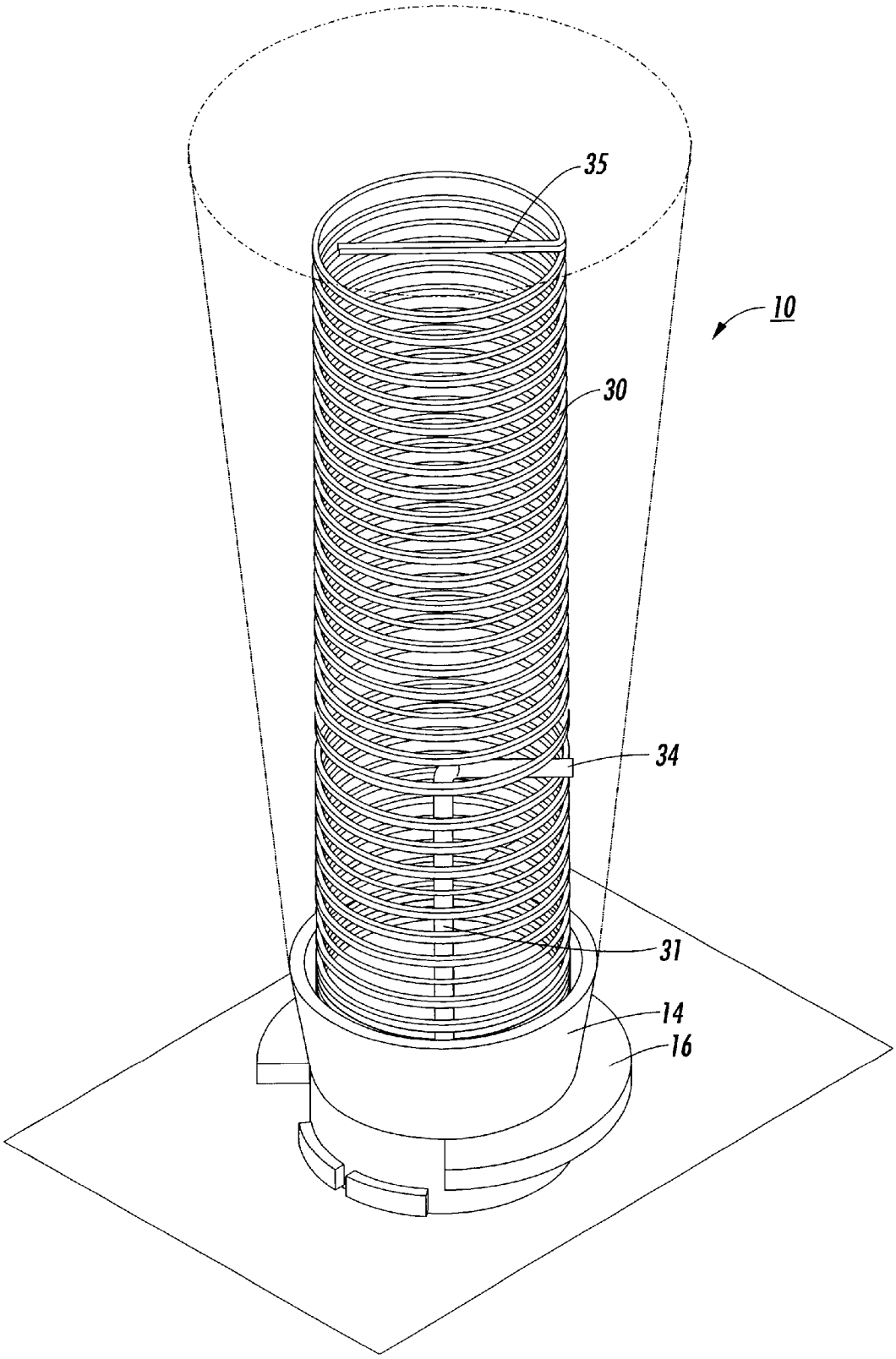
FIG. 5 is an elevated side view of an agitating device of the present invention in its extended position after release from its lock-down mechanism.

Turning now to FIG. 5, agitating device 30 is shown in its extended position after its release from lock-down mechanism 31. In the embodiment shown, agitating device 30 comprises a coiled metal compression spring. When released by lock-down mechanism 31, the spring of agitating device 30 moves through the particulate matter such as toner particles 18 (shown in FIG. 1) until the spring reaches its full extension. Release of the stored potential energy in such coiled metal spring typically carries its full extension beyond its final rest position shown in FIG. 5. The result is an advantageous oscillating motion that dampens into the final rest position shown in FIG. 5. Such oscillating motion serves to further agitate and aerate the toner or other particulate matter, thereby increasing the probability that all clumps and bridges are broken apart by the agitation. In effect, therefore, the described embodiment of the present invention shows an agitating device mechanism that releases its stored potential energy in a primary single stroke, such single stroke motion having secondary oscillating motions that end once all potential energy has been expended.

The net effect of release of agitation device 30 of the present invention is movement of an agitation member through particulate or matter that has congealed. A well designed agitating device 30 will conform sufficiently to the shape, including height and cross-sectional measurements, of the container to agitate essentially the entire volume of particulate or congealed matter. If necessary, a large container may utilize as many separate agitating devices as necessary to achieve the desired effect. Once agitation is complete, the advantages include greater assurance that all particulate or congealed matter will flow out from the container. Additionally, aeration of the matter usually makes flow of the materials smoother and more uniform. Lastly, the density of flowing material will be made more uniform since clumps will be broken apart and the materials will be at least partially mixed and aerated.

Figure 6:
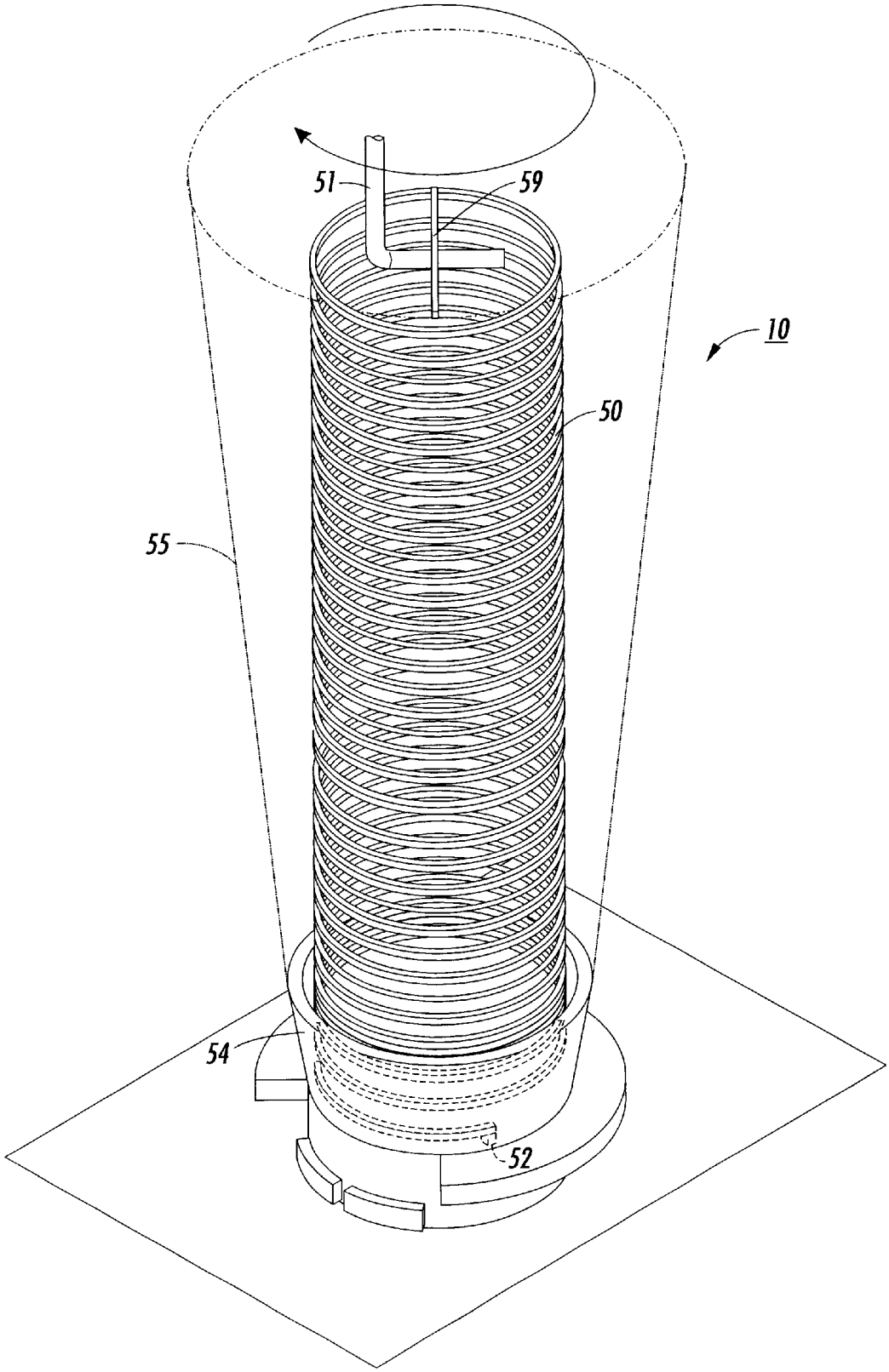
FIG. 6 is an elevated cross-sectional view of an exemplary second toner cartridge of the present invention.

Turning now to FIG. 6, an embodiment of the present invention in which the potential energy storage device stores energy under tension rather than compression is shown. This embodiment closely resembles the embodiment in FIGS. 1–5 except that the potential energy storage device 50 in FIG. 6 is a coiled spring stored under tension. Lock-down device 51 is a simple hook formed in the plastic of toner bottle 55. The coiled spring terminates in a release mechanism 59 identical to release mechanism 35 shown in FIG. 3, which is the terminal portion of spring 50 bent to bisect the circumference of spring 50. In contrast to the embodiment of FIG. 1, spring 50 and its terminal releasing mechanism 59 is prevented from rotating. In FIGS. 1–5, the lock-down mechanism 51 was prevented from rotating. Such fixed orientation of spring 50 is determined by a locking pin 52 that operates similarly to the locking pin 32 of FIG. 1. When bottle 55 is rotated in the manner described above, lock-down device 51, which is fixedly molded into bottle 55, rotates in relation to fixed releasing mechanism 59. The result is that after sufficient rotation of bottle 15 and its attached lock-down mechanism 51, release mechanism 59 slips free from lock-down mechanism 51, and spring 50 releases its potential energy by rapid compressive motion toward the container cap 54. As in the embodiment shown in FIGS. 1–5, release of the potential energy in the potential energy storage device 50 causes movement of the agitator device which, in this embodiment as in the embodiment shown in FIGS. 1–5, is the spring 50 itself. As the coils of spring 50 are pulled toward container cap 54, any clumps or bridges that have formed in the toner particles are broken apart. One possible advantage of the embodiment shown in FIG. 6 is that the motion of spring 50 is primarily in the direction of container cap 54 and aperture 20 of receiving receptacle 11. Materials are thus urged toward the opening through which they are intended to flow.

As will be understood from the embodiments of FIGS. 1–5 and of FIG. 6, many variations of the present invention are possible. As discussed above, any number of devices capable of mechanically storing potential energy in a spring-like fashion may operate to move agitator members such as spring 30 of FIGS. 1–5 and spring 50 of FIG. 6. In FIG. 6, where the potential energy storage device stores energy under tension, elastic devices such as rubber bands are particularly suited for use in the present invention.

In review, the internal agitation mechanism of the present invention includes an agitating device that stores potential energy capable of being released inside a container or other vessel holding particulate or congealed matter. Such agitating device may be an element separate from the spring member or, as shown in FIGS. 1–6, comprise the same element. When compared to known agitating devices and methods in the prior art, the present invention enables less reliance upon human operators and a mechanism that does not require the container or vessel to be rotated or otherwise moved. When applied to cartridges for containing toner, the present invention can be implemented for relatively minor cost while increasing customer satisfaction and preventing warranty and service events.

It is, therefore, evident that there has been provided in accordance with the present invention an internal agitating mechanism that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A mechanism for agitating material held in a container, comprising:

a. a spring member that stores potential energy;

b. a lock-down mechanism that prevents release of energy from the potential energy storage device;

c. a releasing mechanism that, when engaged with the lock-down mechanism, prevents release of the potential energy from the spring member and, when disengaged from the lock-down mechanism, allows release of such potential energy from such spring member; and d. an agitating member powered upon release of potential energy from the spring member, at least a portion of such agitating member being powered to move through the material held in the container.

2. The mechanism of claim 1, wherein the spring member and the agitating member comprise the same member.

3. The mechanism of claim 1, wherein the spring member comprises a material that stores energy when compressed.

4. The mechanism of claim 1, wherein the spring member comprises a material that stores energy when under tension.

5. The mechanism of claim 1, wherein the spring member is a coiled spring.

6. The mechanism of claim 1, wherein the spring member is a negator spring.

7. The mechanism of claim 1, wherein the spring member is a leaf spring.

8. The mechanism of claim 1, wherein the spring member is compressed foam.

9. The mechanism of claim 1, wherein the agitating member is located inside a container holding particulate matter.

10. The mechanism of claim 1, wherein the agitating member is located inside a container holding material that has congealed.

11. The mechanism of claim 1, wherein the agitating member is located inside a cartridge containing marking materials.

12. The mechanism of claim 1, wherein the agitating member is located inside a cartridge containing toner particles.

13. The mechanism of claim 1, wherein the agitating member oscillates after being powered by release of the potential energy.

14. The mechanism of claim 1, wherein the releasing mechanism becomes disengaged from the lock-down mechanism during rotation of its orientation relative to the lock-down mechanism.

15. The mechanism of claim 1, wherein the agitating member is located inside a container containing pelletized waxy material.

16. The mechanism of claim 1, wherein the agitating member is located inside a container containing granulated material.

17. The mechanism of claim 1, wherein the releasing mechanism is fixedly linked to the container and wherein rotation of the container causes disengagement of the releasing mechanism from the lock-down mechanism.

18. The mechanism of claim 1, further comprising:

a. a closure mechanism having a position that seals the container and a position in which the container is at least partially opened; and b. a linkage between the releasing mechanism and the closure mechanism such that the releasing mechanism becomes disengaged from the lock-down mechanism during a period in which the closure mechanism is in an open position.

19. A process for agitating material held in a container, comprising:

a. storing potential energy in a spring member;

b. engaging a releasing mechanism with a lock-down mechanism to prevent release of the potential energy stored in the spring member;

c. releasing the potential energy from the spring member upon disengagement of the releasing mechanism from the lock-down mechanism; and d. agitating the material held in the container by an agitating member powered by the released potential energy.

20. The process of claim 19, wherein the step of agitating comprises moving at least a portion of the spring member.

21. The process of claim 19, further comprising oscillating at least a portion of the agitating member while agitating the material.

22. The process of claim 19, wherein the step of agitating comprises agitating toner particles held in the container.

23. The process of claim 19, wherein the step of releasing further comprises rotating the orientation of the releasing mechanism relative to the lock-down mechanism.

24. The process of claim 19, further comprising linking the releasing mechanism to the container and wherein the step of releasing further comprises rotating the container.

25. A process for agitating marking materials in a cartridge, comprising:

a. storing potential energy in a spring member;

b. engaging a releasing mechanism with a lock-down mechanism to prevent release of the potential energy stored in the spring member;

c. releasing the potential energy from the spring member upon disengagement of the releasing mechanism from the lock-down mechanism; and d. agitating the marking materials held in the cartridge by an agitating member powered by the released potential energy.

26. The process of claim 25, further comprising moving toner materials from the cartridge into a marking system after commencement of the step of agitating.

27. The process of claim 25, wherein the marking material comprises electrophotographic toners.

28. The process of claim 27, wherein the marking material comprises waxy pellets.

29. A cartridge for holding marking material, comprising:

a. device that stores potential energy;

b. a lock-down mechanism that prevents release of energy from the potential energy storage device;

c. a releasing mechanism that, when engaged with the lock-down mechanism, prevents release of the potential energy from the potential energy storage device and, when disengaged from the lock-down mechanism, allows release of such potential energy from such potential energy storage device; and d. an agitating member powered upon release of potential energy from the potential energy storage device, at least a portion of such agitating member being powered to move through the marking material held in the cartridge.

30. The cartridge of claim 29, wherein the agitating member is in a cartridge that holds electrophotographic toners.

31. The cartridge of claim 29, wherein the agitating member is in a cartridge holding waxy pellets.

* * * * *